US012127582B1

(12) United States Patent
Ellis

(10) Patent No.: US 12,127,582 B1
(45) **Date of Patent: *Oct. 29, 2024**

(54) PRE-ROLL OIL INFUSION APPARATUS

(71) Applicant: Credence Engineering, Inc., Tempe, AZ (US)

(72) Inventor: James Edward Ellis, Tempe, AZ (US)

(73) Assignee: Credence Engineering, Inc, Tempe, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/662,163

(22) Filed: May 13, 2024

Related U.S. Application Data

(63) Continuation of application No. 18/363,638, filed on Aug. 1, 2023, now Pat. No. 11,980,221.

(51) Int. Cl.
*A24C 5/02* (2006.01)
*A24C 5/00* (2020.01)
*A24D 1/18* (2006.01)

(52) U.S. Cl.
CPC ..... *A24C 5/02* (2013.01); *A24C 5/002* (2013.01); *A24D 1/18* (2013.01)

(58) Field of Classification Search
None
See application file for complete search history.

(56) References Cited

U.S. PATENT DOCUMENTS

| | | | |
|---|---|---|---|
| 5,199,604 A | 4/1993 | Palmer | |
| 5,479,968 A | 1/1996 | Sanchez | |
| 6,360,794 B1 | 3/2002 | Turner | |
| 7,367,170 B2 | 5/2008 | Hafker | |
| 8,807,177 B2 | 8/2014 | Strangis | |
| 10,440,989 B2 | 10/2019 | Gardella | |
| 10,583,949 B1 | 3/2020 | Ellis | |
| 2006/0266431 A1 | 11/2006 | Gonelli | |
| 2012/0241045 A1 | 9/2012 | Aouad | |
| 2014/0283854 A1 | 9/2014 | Magne | |
| 2017/0121169 A1 | 5/2017 | Dailey | |
| 2017/0233114 A1 | 8/2017 | Christensen | |
| 2021/0267265 A1* | 9/2021 | Partansky | B67D 3/0022 |
| 2023/0200433 A1 | 6/2023 | Partansky | |

OTHER PUBLICATIONS

"E5 Optical Kit Encoder Datasheet", published by US Digital, Vancouver, Washington, May 25, 2023.

* cited by examiner

*Primary Examiner* — Phu H Nguyen
(74) *Attorney, Agent, or Firm* — Haynes and Boone, LLP

(57) ABSTRACT

Pre-roll infusing apparatus includes fluid vessel, a fluid pump and an infusion needle for spraying fluid into the pre-roll. An elevator includes a tube nest for receiving a support tube containing the pre-roll and selectively raises the pre-roll to be pierced by the needle. A needle heater is supported for travel along the needle as the elevator moves up and down. The elevator tube nest includes a motor-driven rotatable base for rotating the support tube and pre-roll during infusion. A stepper motor equipped with an encoder controls the raising and lowering of the elevator. The needle may include two or more spaced spray ports. A needle pointer indicates to a user the location of the needle spray ports. The fluid vessel includes a stirrer motor, and the current draw thereof is used to determine the viscosity of the fluid. Different support tubes are provided to accommodate different pre-roll styles.

3 Claims, 17 Drawing Sheets

PRE-ROLL OIL INFUSION APPARATUS

CROSS-REFERENCE TO RELATED PATENT APPLICATION

This non-provisional patent application is a continuation of, and claims the benefit of the earlier filing date of, prior-filed U.S. non-provisional patent application Ser. No. 18/363,638, filed on Aug. 1, 2023, entitled "Pre-Roll Infusion Apparatus", under 35 U.S.C. 120.

BACKGROUND OF THE INVENTION

Technical Field

The present invention relates generally to apparatus for infusing an oil into a generally cylindrical porous object, and more particularly to apparatus for infusing an oil into a pre-roll cannabis blunt.

State of the Art

In the cannabis industry, so-called "pre-rolls" have become increasingly popular. A pre-roll consists of ground or crushed cannabis buds, or "flower", typically wrapped within smoking paper or a tobacco leaf wrapper, though some are now wrapped in hemp paper. Often, a filter tip is incorporated. Pre-rolls are generally able to contain a greater amount of cannabis flower than a conventional rolled joint. Pre-rolls are sold already rolled and are ready to be lit and smoked. Pre-rolls also tend to burn down at a slower pace as compared with conventional rolled joints.

More recently, it has become known to infuse such pre-rolls with various oil-based concentrates. Among the most popular oil-based concentrates is THC oil which, when infused within a pre-roll, increases the amount of THC consumed with each inhalation from the pre-roll, and hence the degree of "high" that is experienced.

However, THC oil is relatively thick, and the application of THC oil to a pre-roll is a complicated process, particularly if it is desired to achieve a relatively uniform infusion of the THC oil within the pre-roll. Because the THC oil is very viscous and sticky, it will often coagulate and clot the equipment used to apply the THC oil to the pre-roll. Unless the source of THC oil is at a sufficiently high temperature, pumping such THC oil in a reliable manner may not be possible. Moreover, if the equipment used to infuse THC oil is left static for a period of time, the THC oil will often coagulate within the injection needle.

In addition, it is generally difficult to apply the THC oil to the pre-roll in a manner that ensures that the THC oil is uniformly distributed therethrough while retaining control over the total quantity of THC oil infused into the pre-roll. In addition, while pre-rolls are often conically-shaped, there are a large number of different types of pre-rolls available, each having somewhat different contours and thicknesses, which further complicates the process of applying THC oil thereto.

It is therefore an object of the present invention to provide an apparatus for infusing pre-rolls with an oil-based concentrate, such as THC oil, wherein the oil can be applied in a controlled manner, and uniformly dispersed within the pre-roll.

Another object of the present invention is to provide such an apparatus which is better able to avoid clogging or coagulation of the oil being infused, thereby minimizing downtime of such apparatus.

Still another object of the present invention is to provide such an apparatus with improved efficiency by infusing a larger number of pre-rolls within a given period of time in a quick, repeatable and reliable manner in order to maximize production rates while maintaining quality control.

A further object of the present invention is to provide such an apparatus which easily adapts from one type of pre-roll to a different type of pre-roll without disassembly or significant re-configuration.

These and other objects of the present invention will become more apparent to those skilled in the art as the description of the present invention proceeds.

SUMMARY OF THE INVENTION

Briefly described, and in accordance with various embodiments thereof, a first aspect of the present invention relates to apparatus for infusing a viscous fluid into a pre-roll. The apparatus includes a supply of viscous fluid and a fluid pump coupled thereto for selectively pumping the viscous fluid to an elongated infusion needle; the infusion needle has one or more spray ports for emitting viscous fluid into a pre-roll pierced by the infusion needle. An elevator is provided for releasably supporting the pre-roll. The elevator selectively raises the pre-roll to be pierced by the infusion needle, and the elevator selectively lowers the pre-roll from the elongated infusion needle. The fluid pump is operated while the needle spray port is within the pre-roll to apply the viscous fluid thereto.

In at least one embodiment of such apparatus, a needle heater encircles a portion of the infusion needle for heating viscous fluid therein. A support member movably supports the needle heater in a manner by which the needle heater is adapted to move upwardly along the infusion needle as the elevator raises the pre-roll, while lowering the needle heater downwardly along the infusion needle as the elevator lowers the pre-roll. In this manner, the needle heater more effectively heats viscous fluid within the infusion needle while avoiding interference with the application process.

In at least one embodiment, the support member used to support the needle heater includes a carriage which slides vertically along a rail, along with a biasing member for urging the carriage downward, and for urging the needle heater toward a lowermost position along the infusion needle. The biasing member yields to upward movement of the elevator for allowing the needle heater to move upwardly along the infusion needle as the elevator raises the pre-roll. The biasing member, in at least one embodiment, includes a spring-biased pivot arm having a first end portion that pivots about a pivot axis and a second end portion coupled with the carriage that supports the needle heater. In at least one embodiment, a portion of the elevator used to support the pre-roll physically engages the needle heater as the elevator raises the pre-roll in order to move the needle heater upwardly along the elongated infusion needle as the elevator raises the pre-roll. Upward movement of the elevator causes the pivot arm to pivot in a first rotational direction against the action of the spring as the needle heater is raised, whereas downward movement of the elevator allows the pivot arm to pivot in a second, opposite rotational direction wherein the spring urges the needle heater toward its lowermost position.

In at least one embodiment, the aforementioned apparatus includes a timer for measuring time which has elapsed after each operation of the elevator. The timer is reset each time the apparatus raises and lowers the elevator. If the elapsed time since the elevator was last raised and lowered exceeds a predetermined threshold, the timer itself triggers a cycle of raising and lowering the elevator without pumping any fluid through the infusion needle in order to move the needle heater along elongated infusion needle to heat viscous fluid within the infusion needle to prevent coagulation of the viscous fluid within the infusion needle between infusion operations.

In at least some embodiments, the elevator of the apparatus includes a nest for releasably receiving a support tube in which the pre-roll is inserted prior to infusion. In some embodiments, two or more different styles of support tubes are provided to accommodate two or more different styles of pre-rolls. A first pre-roll has a first contour, and a second pre-roll has a second contour different from the first contour. A first support tube for supporting the first pre-roll has a first internal contour corresponding to the contour of the first pre-roll. A second support tube for supporting the second pre-roll has a second internal contour corresponding to the contour of the second pre-roll. The elevator has a tube-support member adapted to releasably receive and support either of the first and second support tubes, although only one at a time. The elevator is adapted to raise the selected support tube toward the infusion needle for allowing the infusion needle to pierce the pre-roll within the selected support tube, and adapted to lower the selected support tube away from the infusion needle. The fluid pump causes the infusion needle to spray fluid into the pre-roll contained within the selected support tube during a selected portion of the movement of the elevator.

In at least some embodiments of the apparatus, the pre-roll is caused to rotate about its longitudinal axis as the viscous fluid is infused into the pre-roll. The pre-roll is supported within a support tube. The elevator includes a rotatable tube-support member for releasably receiving at least a portion of the pre-roll support tube, and further includes a bearing for rotatably supporting the tube-support member upon the elevator. A tube rotation motor is supported by the elevator and adapted to rotate the tube-support member when the infusion needle is spraying fluid, thereby causing the support tube, and the pre-roll supported thereby, to spin about its longitudinal axis. The pre-roll is thereby rotated around the infusion needle while the infusion needle is spraying fluid. In at least one embodiment, the tube-support member includes a first drive ring, and the shaft of the tube rotation motor is coupled to a second drive ring. The first and second drive rings are coupled to each other, as by a drive belt, whereby operation of the tube rotation motor results in rotation of the tube support member. In at least some embodiments, an electronic controller operates the tube rotation motor substantially simultaneously with the operation of the fluid pump whereby the tube-support member is rotated when the infusion needle is emitting viscous fluid.

In one embodiment of the apparatus, the infusion needle includes multiple spray ports for emitting viscous fluid, wherein the multiple spray ports are angularly spaced from each other at substantially equal angular increments about the longitudinal axis of the infusion needle for more evenly dispensing the viscous fluid within a pre-roll to be infused. In one such embodiment, four spray ports are provided, spaced at 90-degree angular increments about the longitudinal axis of the infusion needle.

In at least one embodiment of the apparatus, the elevator is raised and lowered by a lift motor coupled with an encoder. The lift motor is engaged with the elevator whereby rotation of the lift motor in a first direction causes the elevator to be raised, and whereby rotation of the lift motor in a second opposing direction causes the elevator to be lowered. The lift motor includes a driveshaft coupled with an encoder. The encoder has an output for generating digital signals representative of the amount by which the lift motor driveshaft has been rotated. In at least one embodiment, the apparatus includes an electronic controller for controlling the operation of the fluid pump and the operation of the lift motor. The electronic controller is coupled to the output of the encoder for receiving the digital signals generated thereby. Based upon information entered by a user, the electronic controller serves to control the speed of the lift motor during operation of the fluid pump in order to control the amount of fluid sprayed by the infusion needle throughout the pre-roll.

In order to facilitate entry of information by a user, at least one embodiment includes a pointer to visually indicate the location of the spray port of the infusion needle even when such spray port is hidden from view. An elongated vertically-oriented member extends generally parallel to the infusion needle, and a pointer is slidingly mounted on the elongated vertically-oriented member. A clamp releasably clamps the pointer to the elongated vertically-oriented member at a selected vertical position whereby the pointer points toward the at least one spray port of the infusion needle.

In some embodiments of the apparatus, a stirrer is disposed within the source of viscous fluid to stir the viscous fluid therein, and a stirring motor is coupled to the stirrer for rotating the stirrer. An electronic controller applies electrical current to the stirring motor for causing the stirring motor to rotate the stirrer. The electronic controller senses the amount of electrical current drawn by the stirring motor when stirring the viscous fluid. When electrical current drawn by the stirring motor exceeds a predetermined threshold, this is an indication that the viscous fluid is too thick to be pumped reliably, and the electronic controller prohibits the operation of the fluid pump. In at least some embodiments, a heater is provided adjacent to the source of viscous fluid for heating the viscous fluid therein. In at least some embodiments, the electronic controller operates the heater when electrical current drawn by the stirring motor exceeds the predetermined threshold.

BRIEF DESCRIPTION OF THE DRAWINGS

A more complete understanding of the present invention may be derived by referring to the detailed description and claims when considered in connection with the accompanying drawings, wherein:

DETAILED DESCRIPTION

Figure 1:
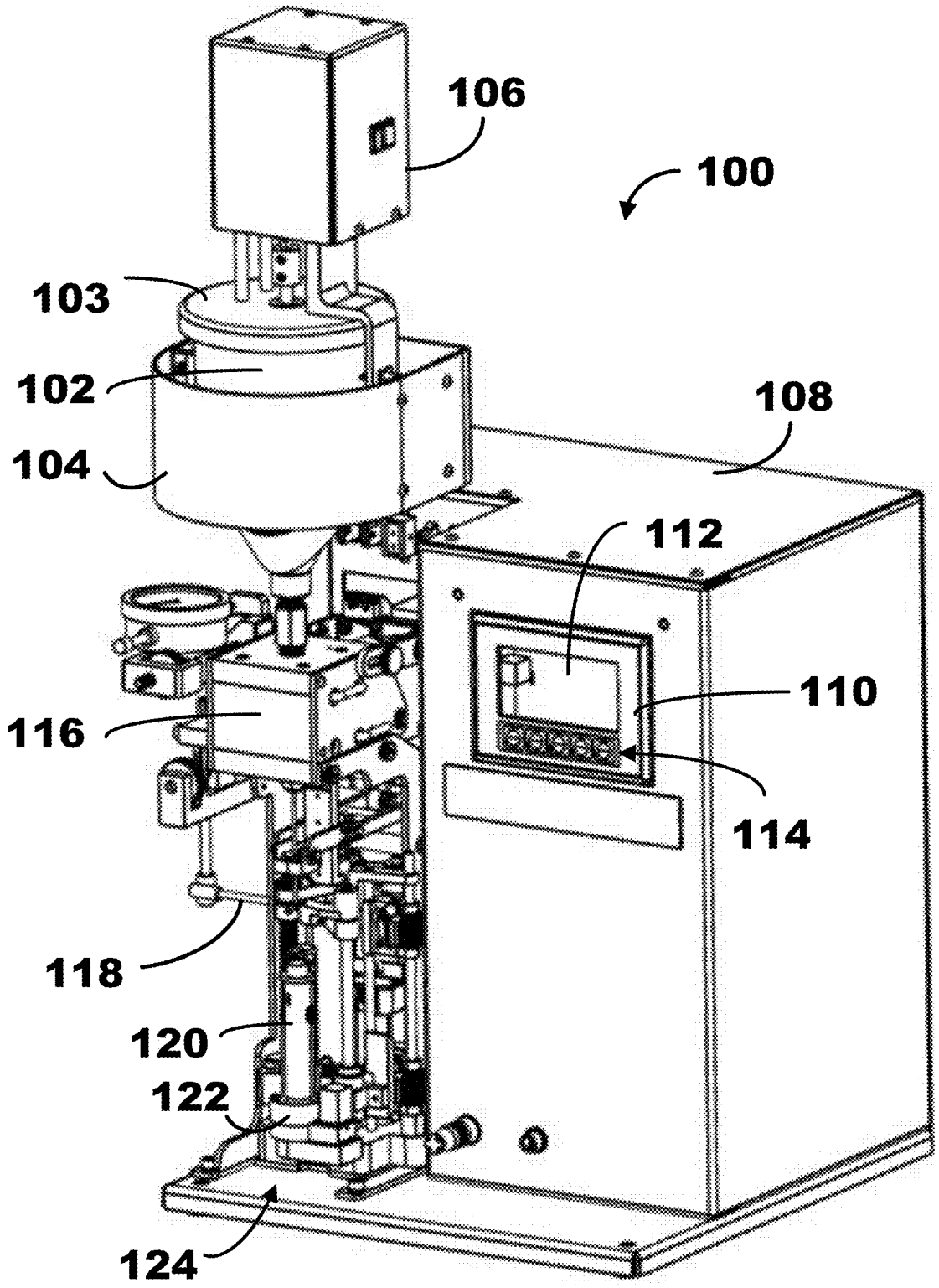
FIG. 1 is a perspective view of an apparatus for infusing pre-rolls with a viscous concentrate.

Shown in FIG. 1 is pre-roll infusion apparatus 100. Pre-roll infuser 100 includes a heating vessel 102 for storing a supply of a viscous fluid, e.g. THC concentrate oil, partially covered by a heat shield 104. A stirring motor 106 is mounted above heating vessel 102 for rotating a stirring impeller extending within heating vessel 102; heating vessel 102 includes a cover 103 which may be opened to add viscous fluid thereto. Cabinet 108 houses electronic circuitry used to control pre-roll infuser 100. A user interface 110 includes a display panel 112 and a series of pushbuttons 114 for allowing a user to make selections prompted by display panel 112. A fluid pump 116 receives viscous fluid from heating vessel 102 and selectively pumps such fluid to an infusion needle. A pointer 118 is positioned to point to the elevation at which one or more spray ports are formed in the infusion needle. A support tube 120 for holding a pre-roll is releasably received within a tube support nest 122. Elevator platform 124 supports tube support nest 122 for raising a pre-roll toward the infusion needle and subsequently lowering the pre-roll away from the infusion needle.

Figure 2:
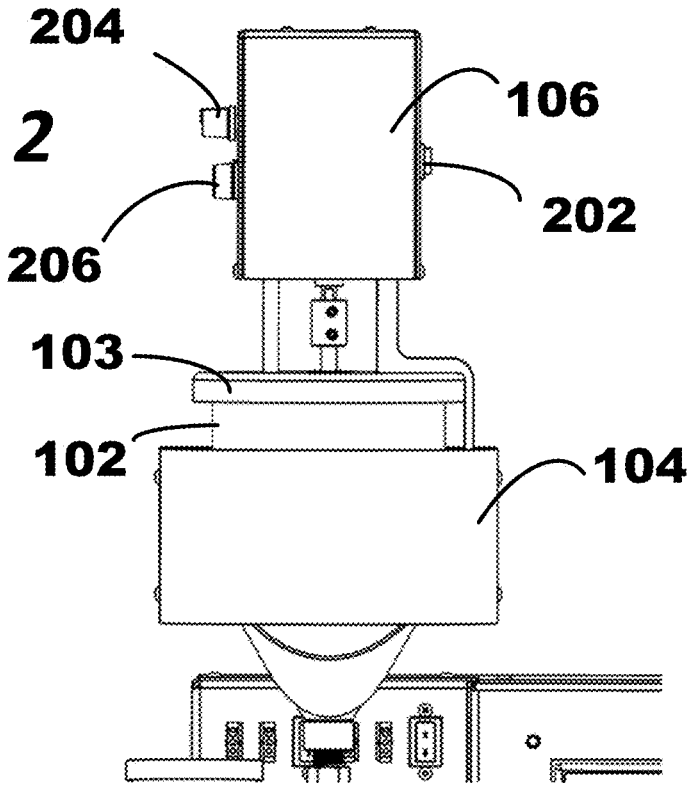
FIG. 2 is a frontal view of the upper portion of the apparatus shown in FIG. 1 including a heating vessel and vessel stirring mechanism.
Figure 3:
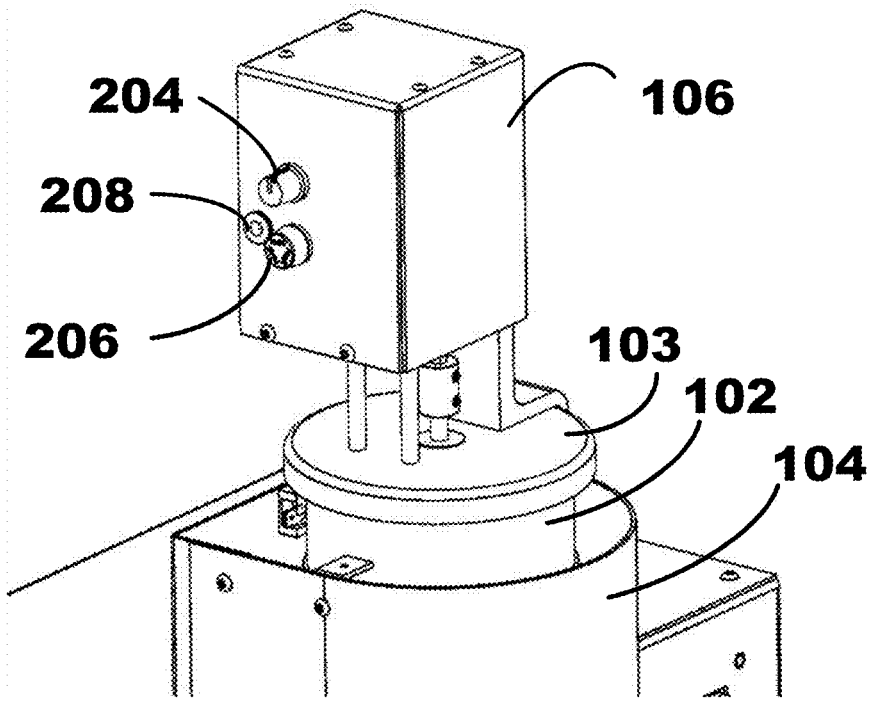
FIG. 3 is a perspective view of the components shown in FIG. 2.

In FIGS. 2 and 3, stirring motor 106 includes an outer housing from which a rocker switch 202 extends from one face for shutting off, or turning on, the stirrer motor 106. A speed potentiometer 204 (used to adjust the speed of stirring motor 106) and a fuse 206 extend from the opposite face of motor housing 106. Power jack 208 is adapted to receive a source of 24 VDC for powering stirrer motor 106.

Figure 4:
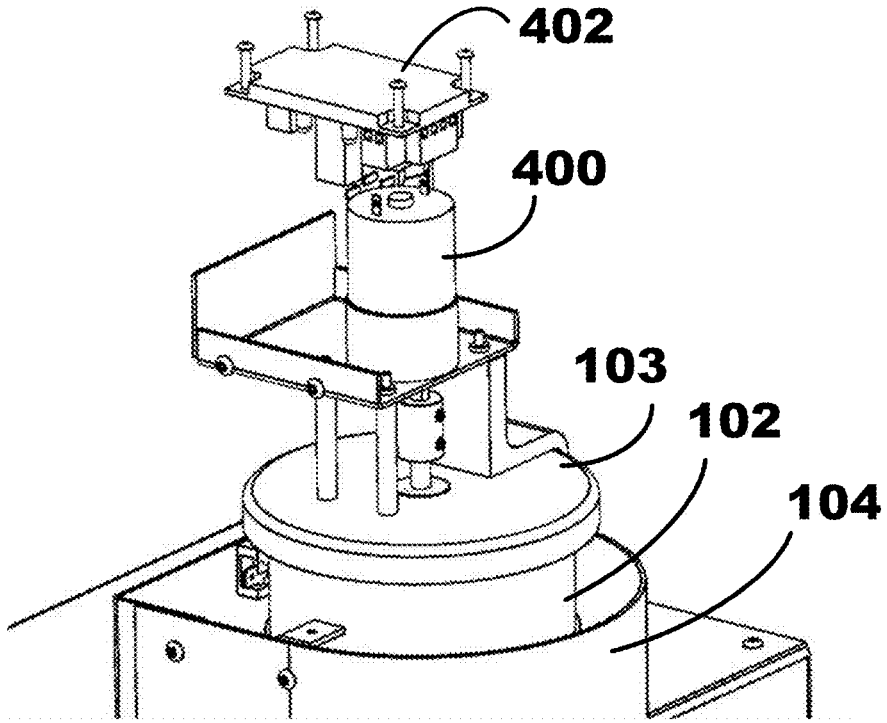
FIG. 4 is a perspective view similar to FIG. 3 but with the stirrer motor housing removed to reveal the stirrer motor.

Turning now to FIG. 4, the outer housing of stirring motor 106 has been removed to reveal components inside. Motor 400 is preferably an Uxcell 24 VDC geared motor rated at up to 100 RPM. A motor driver board 402 controls the operation of motor 400 based upon speed rocker switch 202, speed potentiometer 204 and control signals exchanged with an electronic controller. Among the signals exchanged with the electronic controller is the amount of current drawn by motor 400 from the 24 VDC supply voltage which is a function of how hard motor 400 must work to stir the contents of heating vessel 102. In turn, the amount of current drawn relates to how viscous is the fluid inside heating vessel 102. When the current drawn by motor 400 exceeds a specified threshold, this is an indication that the vessel heater(s) should be activated to heat the viscous fluid and make it easier to pump.

Figure 5:
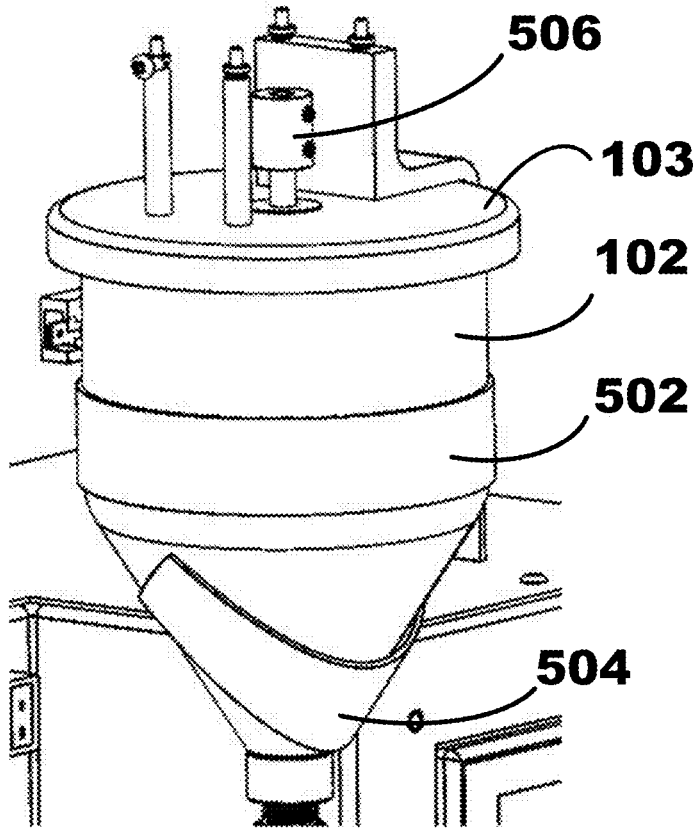
FIG. 5 is a perspective view of the viscous fluid heating vessel after removing the stirrer motor and heat shield.

Now referring to FIG. 5, stirring motor 400 has been removed for clarity. Heating vessel 102 is encircled by flexible heating band 502, which may be of the type Tempco SHS80350 flexible heater which provides up to 120 Watts of heat output for heating the contents of heating vessel 102. To provide additional heating to the lowermost portion of heating vessel 102 (where fluid exits to the fluid pump), a supplemental heater 504 is secured; supplemental heater 504 may be of the type Tempco SHS80338 which provides 60 Watts of heat output. As can be seen in FIG. 5, a shaft coupler 506 is provided having set screws for coupling the driveshaft of stirring motor 400 to the shaft of a stirring impeller which extends through cover 103 and inside heating vessel 102.

Figure 6:
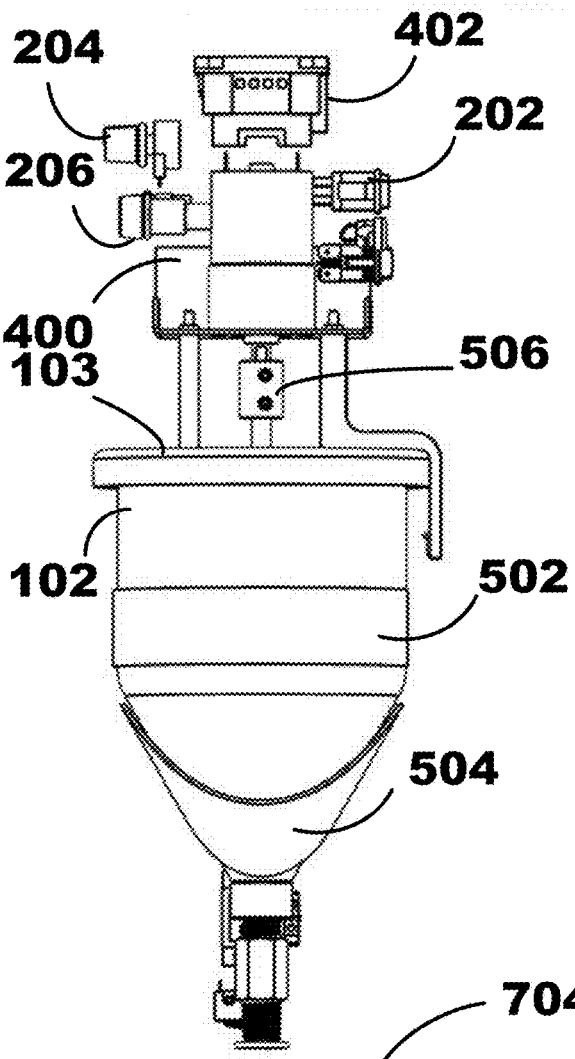
FIG. 6 is a front view of stirrer motor and viscous fluid heating vessel with the heat shield removed.
Figure 7:
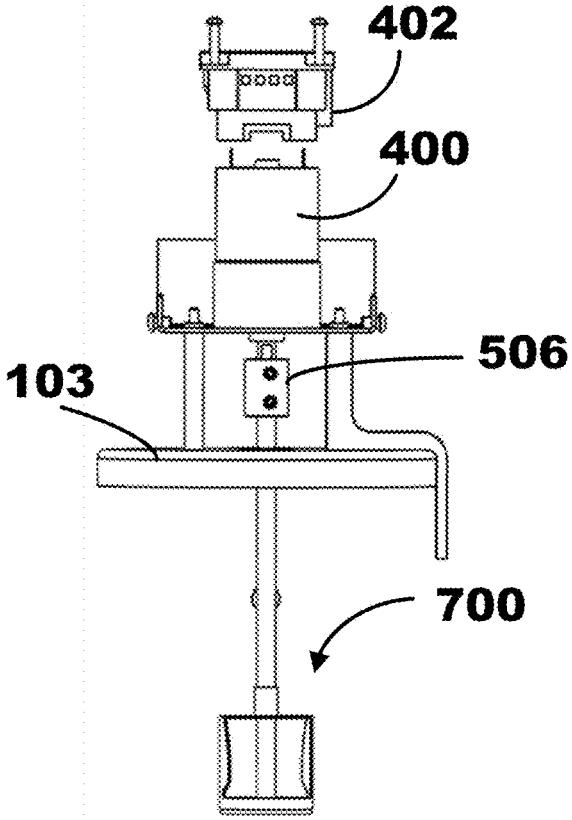
FIG. 7 is a front view similar to FIG. 6 but with the viscous fluid heating vessel removed to reveal the stirring impeller.
Figure 8:
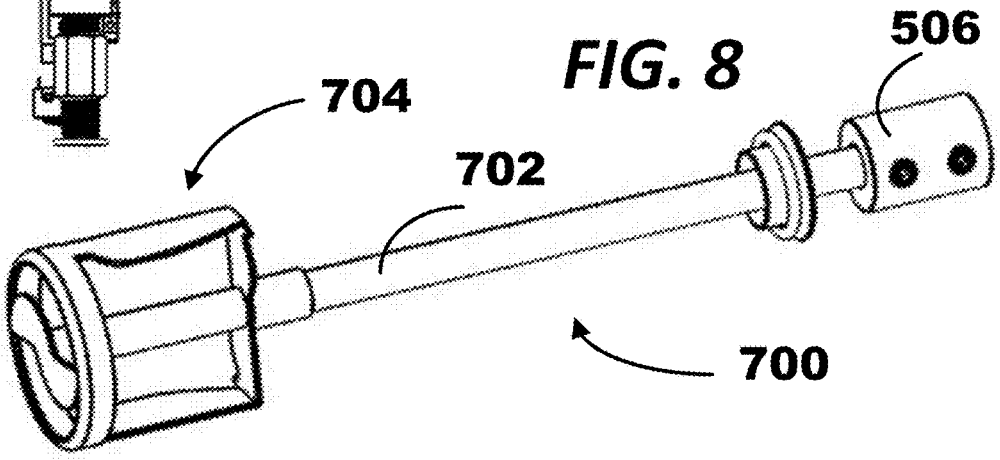
FIG. 8 is a perspective view of the stirring impeller shown in FIG. 7.

FIG. 6 is a frontal view of the stirring motor and heating vessel components described above. In FIG. 7, heating vessel 102, and heaters 502 and 504 have been hidden to reveal stirring impeller 700 used to stir the viscous fluid within heating vessel 102. As shown in FIG. 8, stirring impeller includes a central shaft 702 secured to shaft coupler 506 at its upper end, and providing stirring blades 704 at its lower end. Stirring impeller 700 may be of the type commercially available under part number MCM3471K5.

Figure 9:
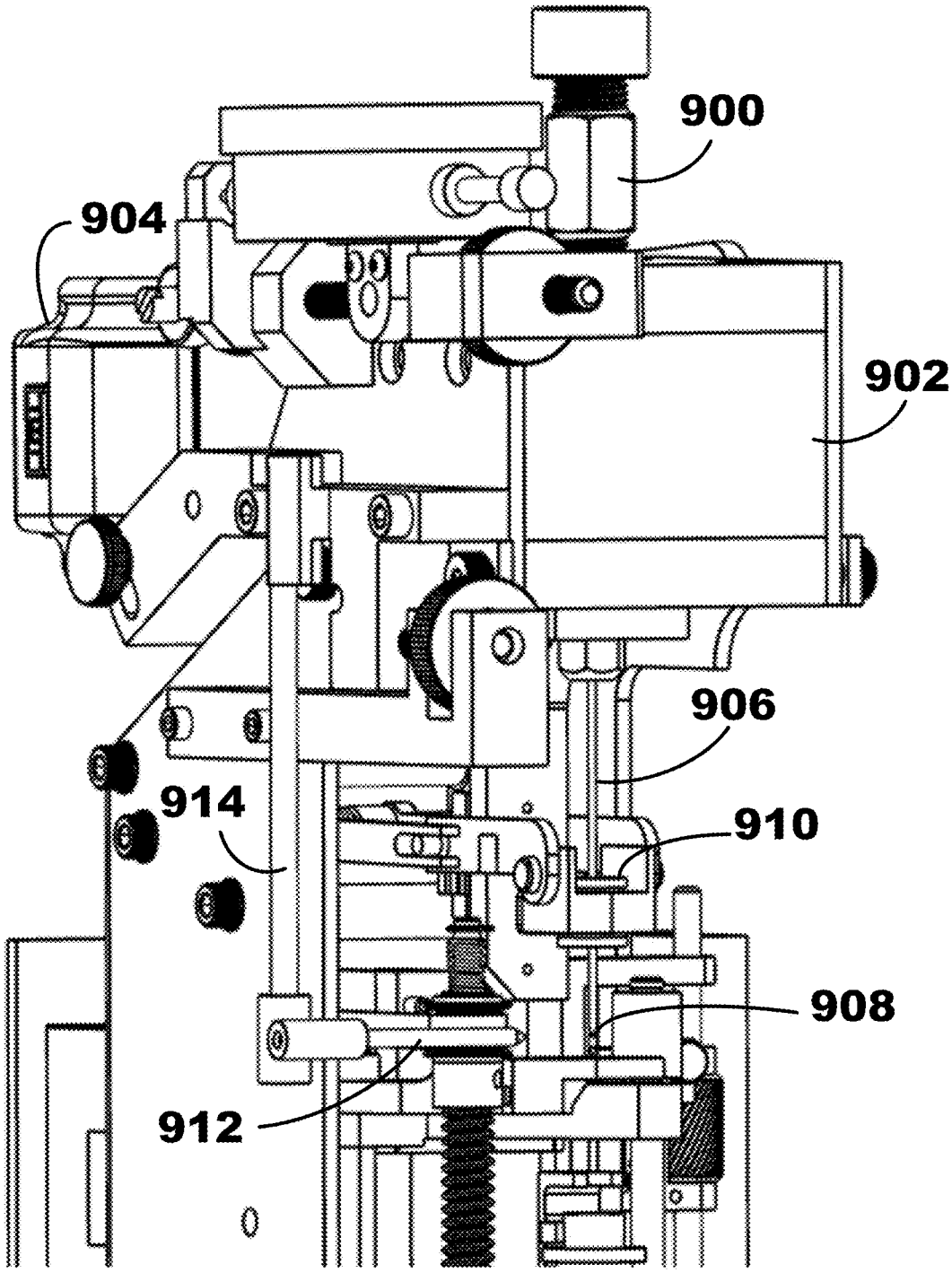
FIG. 9 is a perspective view of the portion of the apparatus including the fluid pump and infusion needle.

Now referring to FIG. 9, the discharge port of heating vessel 102 communicates through high-pressure fitting 900 to the inlet of fluid pump housing 902. Pump motor 904 is visible behind fluid pump housing 902, and pump motor 904 is operated to pump viscous fluid from pump 902 to elongated infusion needle 906 for emitting the viscous fluid from spray port 908. While not shown, fluid pump 902 may incorporate cartridge heaters in the pump head for heating viscous fluid within the fluid pump. A needle heater 910 is supported to encircle infusion needle 906 in a manner which allows needle heater 910 to rise along infusion needle 906 when a pre-roll is being elevated for infusion, and to lower itself along infusion needle 906 when the pre-roll is lowered back down. Needle heater 910 is designed to heat up to around 120 degrees C. Also visible in FIG. 9 is a needle spray port pointer 912 slidingly supported upon vertical rod 914. Pointer 912 is adjusted vertically along rod 914 so that it points to spray port 908 of infusion needle 906. A releasable clamp is then tightened to maintain pointer 912 in the desired position.

Figure 10:
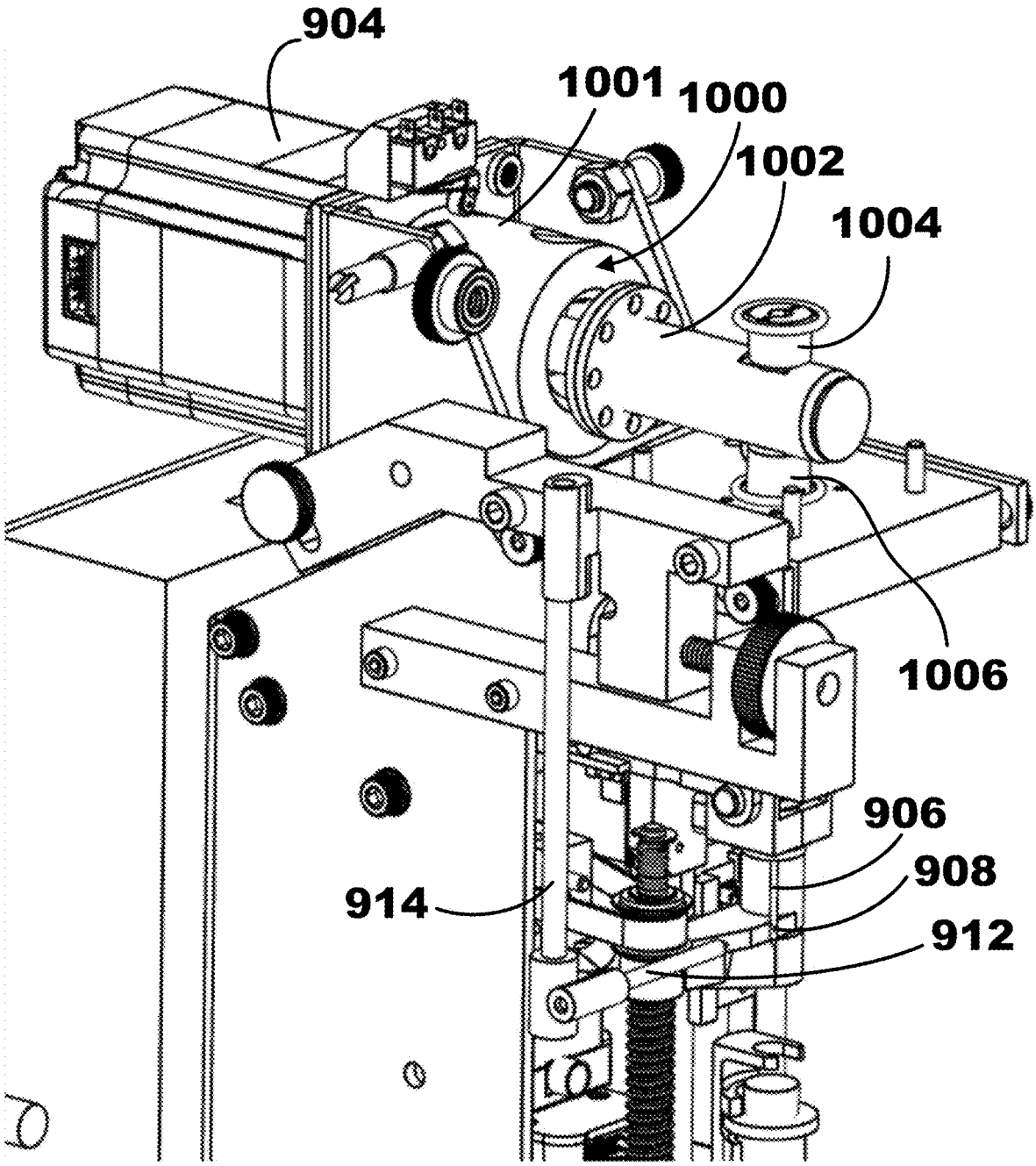
FIG. 10 is a perspective view of the components shown in FIG. 9 but wherein certain housings have been hidden to better show the fluid pump and associated pump motor.

In FIG. 10, the outer housing 902 of the fluid pump has been hidden to reveal pump assembly 1000 therein. Pump assembly 1000 includes a pump rotation drum 1001 and ceramic sleeve 1002 which includes a piston (not shown). Viscous fluid enters the pump via port 1004, and exits the pump via port 1006 for coupling with the infusion needle.

Ceramic sleeve 1002 and its associated piston may be of the type commercially available from Fluid Metering Inc. under part number QA41111C.

Figure 11:
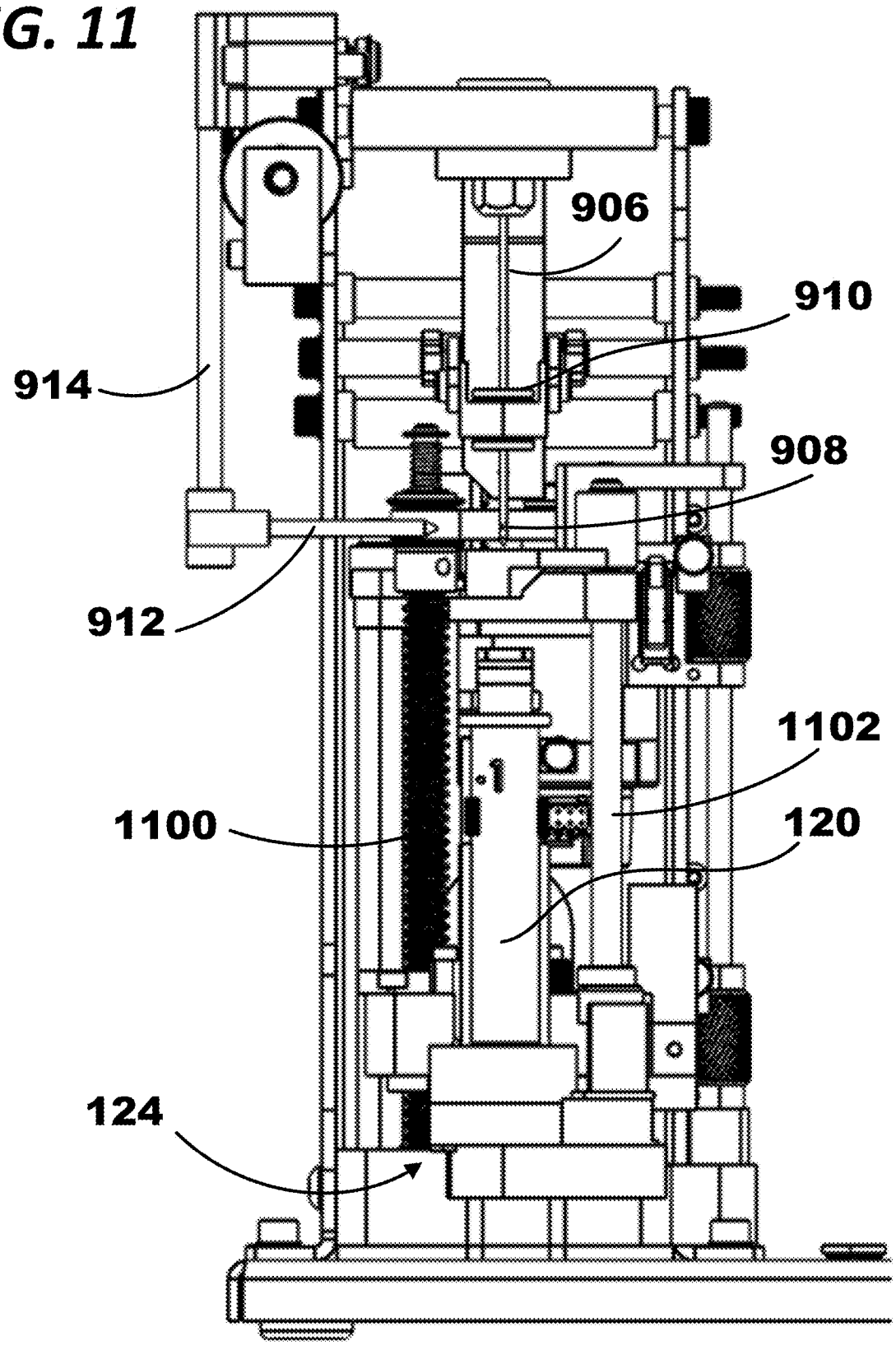
FIG. 11 is a front view of that portion of the lower portion of the apparatus including the infusion needle, needle heater, spray port pointer, and tube elevator.

Turning now to FIG. 11, needle heater 910 is shown in its lowermost position slightly above spray port 908 of infusion needle 906. Support tube 120 rests upon elevator 124, with support tube directly below infusion needle 906. Elevator 124 is raised and lowered by screw rod 1100 which is rotatable within bearings provided at its upper and lower ends. Elevator 124 is also engaged with guide shaft 1102, and elevator 124 slides along guide shaft 1102 as it is raised and lowered by screw rod 1100.

Figure 12:
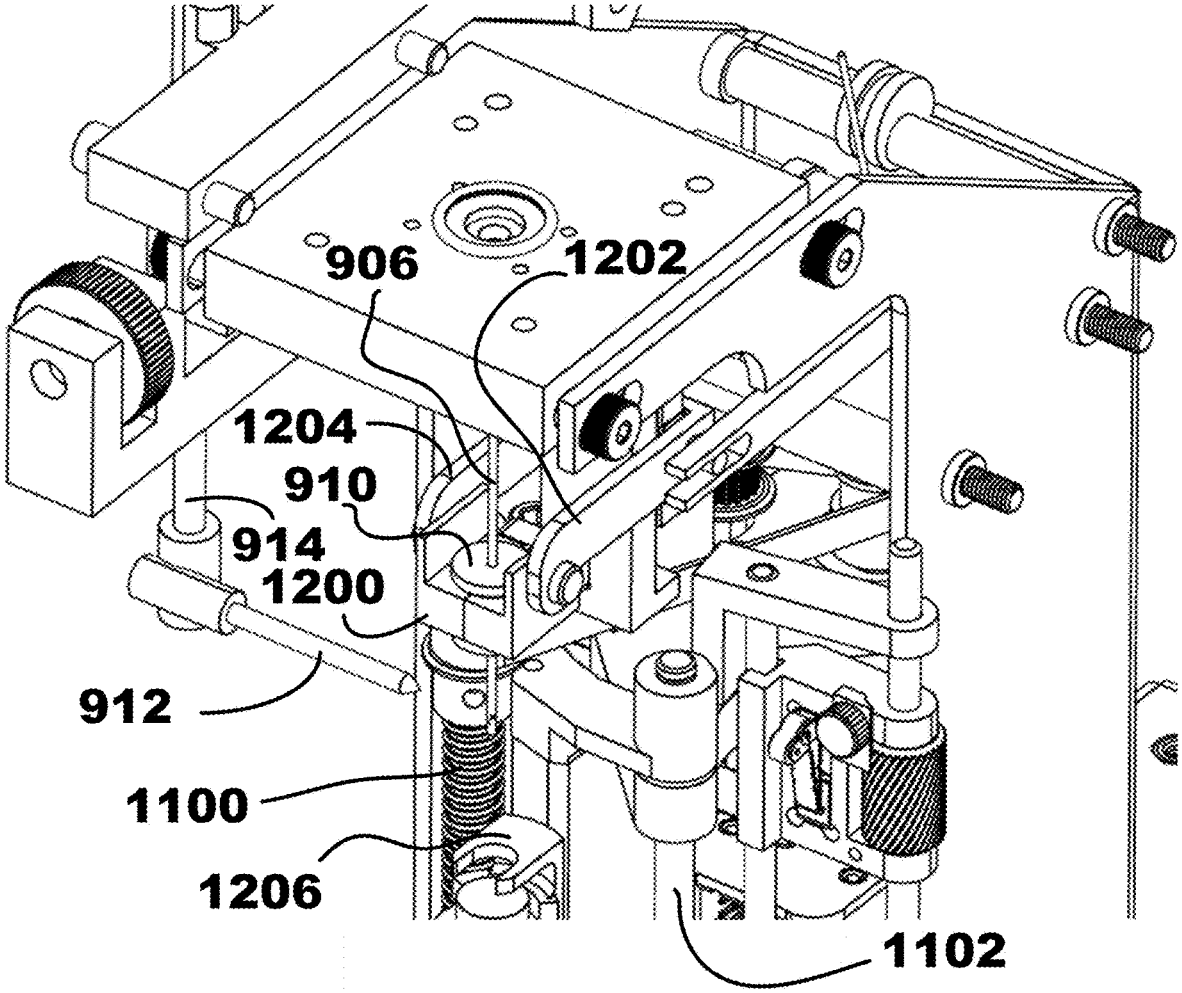
FIG. 12 is a perspective view of the infusion needle, needle heater and spray port pointer.

In FIG. 12, needle heater 910 is supported by a bracket 1200 which is pivotally suspended from a pair of forwardly directed arms 1202 and 1204. As will be explained below, arms 1202 and 1204 are supported by a carriage which slides vertically along a rail, allowing needle heater 910 to slide up and down infusion needle 906. Visible within the lower portion of FIG. 12 is the upper portion 1206 of the tube support nest of the tube support elevator 124. As the elevator raises the tube support nest, upper portion 1206 contacts the lower portion of needle heater 910 and physically forces needle heater 910, its supporting bracket 1200, needle support arms 1202 and 1204 upwardly, allowing needle heater 910 to traverse the upper portion of infusion needle 906 even as the lower portion of infusion needle 906 pierces the pre-roll inside the tube support member.

Figure 13:
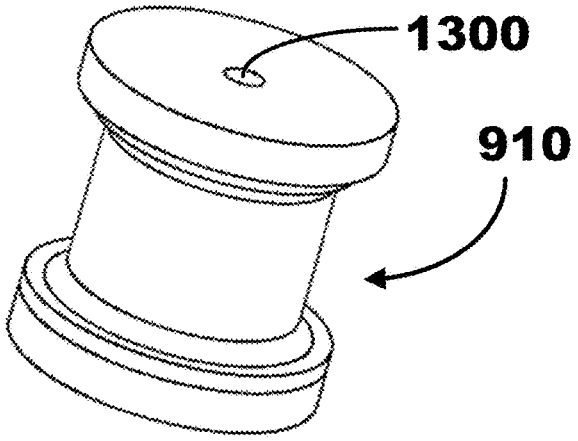
FIG. 13 is a perspective closeup view of the needle heater.

Needle heater 910 is shown in isolation in FIG. 13. As can be seen, needle heater 910 resembles a thread spool including a central bore 1300 for extending about infusion needle 906. Fine electrical wires (not shown) extend to needle heater 910 to supply electrical current resistance elements therein to create heat for heating viscous fluid within infusion needle 906.

Figure 14:
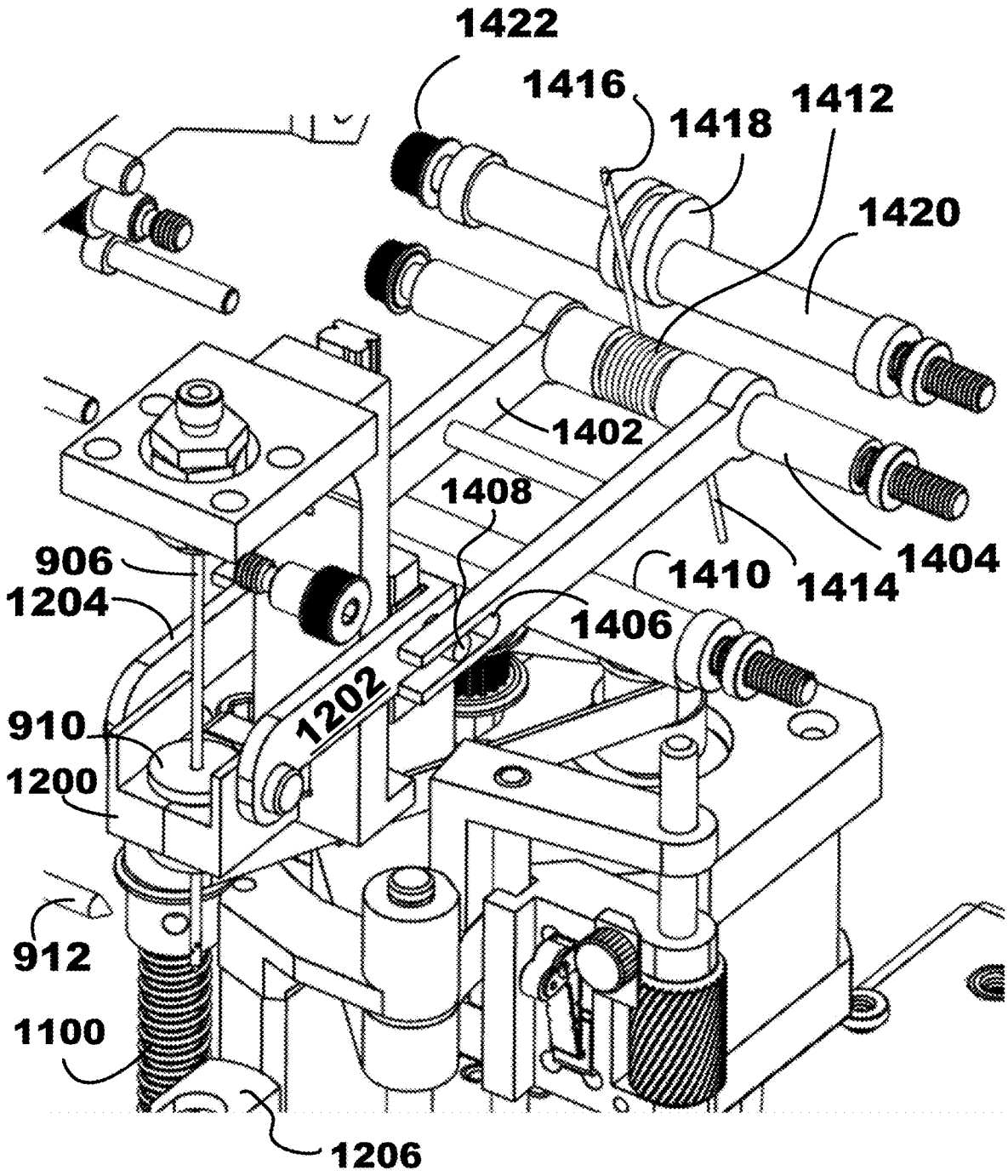
FIG. 14 is a perspective view similar to that of FIG. 13 but with some components hidden from view to reveal needle heater support components.

As has been explained above, the pre-roll infuser apparatus may include a biasing member for urging needle heater 910 toward its lowermost position as the elevator lowers the pre-roll support tube. In this regard, FIG. 14 shows a pair of pivot arms 1400 and 1402 which each has a first end extending from pivot axle 1404; pivot arms 1400 and 1402 serve as spring beams. The second opposing end of pivot arm 1400 has a split end 1406 for slidingly engaging a pin 1408 extending from needle support arm 1202; likewise, pivot arm 1402 includes a split end (not visible in FIG. 14) for engaging a like pin extending from needle support arm 1204 on the opposite side. Pivot arms 1400 and 1402 can only lower so far before contacting axle 1410, which serves as a positive stop against further downward movement of pivot arms 1400 and 1402. Biasing spring 1412 is wound about pivot axle 1404 and has a first end 1414 that is anchored to be fixed, and a second opposing end 1416 which engages an eccentric cam 1418 secured to rotatable shaft 1420. Biasing spring applies a torsional force to pivot axle 1404 urging it to rotate pivot arms 1400 and 1402 downwardly, and the remote split ends 1408 of pivot arms 1400 and 1402 transfer such biasing force to the pins 1408 extending from needle support arms 1202 and 1204. By rotating shaft 1420, along with cam, 1418, as by rotating adjustment knob the torsional force applied by biasing spring 1412 to pivot axle 1404 can be adjusted.

On the other hand, when the tube support elevator 124 rises, and the top 1206 of the tube support nest contacts needle heater 910, the downward biasing force applied by spring 1412 and pivot arms 1400 and 1402 is overcome, and needle heater 910, bracket 1200, and support arms 1202 and 1204 are all lifted upwardly for allowing needle heater 910 to move upwardly along infusion needle 906 as the elevator raises the pre-roll. In turn, pivot arms 1400 and 1402 are forced to rotate upwardly against the force exerted by biasing spring 1412. When the elevator lowers the tube support member once again, pivot arms 1400 and 1402 rotate back downwardly to urge needle heater 910 back down.

Figure 15:
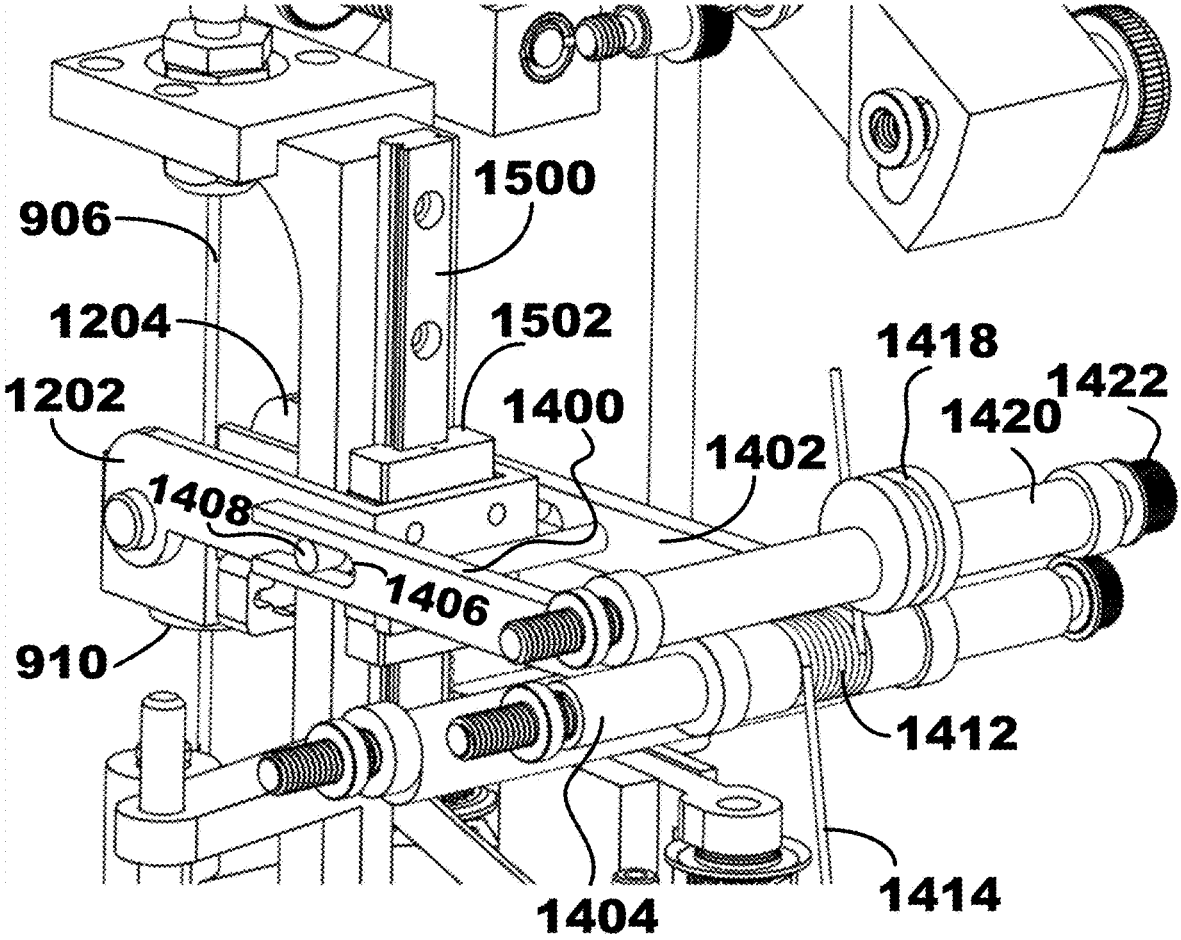
FIG. 15 is a perspective view of components shown in FIG. 15 but viewed from the rear.

Referring now to FIG. 15, the components described in FIG. 14 are shown from the rear of the apparatus. In this view, a vertical slide rail 1500 is visible. A ball-bearing carriage 1502 is engaged over the sides of rail 1500 for sliding movement up and down along rail 1500. In turn, needle heater support arms 1202 and 1204 are secured to carriage 1502 for sliding upwardly and downwardly along with carriage 1502.

One of the advantages of configuring needle heater 910 in the manner described above is that it may be cycled to perform its function of heating a significant length of the infusion needle even when normal operation of the pre-roll infuser is interrupted. For example, it is not unusual for normal cycling of the tube support elevator 124 to be interrupted while an operator goes on a break. The ambient air can cause infusion needle 906 to cool during periods of inactivity which allows the oil inside infusion needle 906 to thicken and clot the needle. If such inactivity goes beyond a prescribed time, elevator 124 is automatically cycled to rise and lift needle heater 910 up along infusion needle 906 to thin the oil inside. This keeps the machine ready to cycle so there is no required warm-up time after the period of inactivity. The permitted delay time before automatically cycling the elevator to perform such needle maintenance can be programmed by a user by using user interface 110. To setup such delay time, a user presses an "OPS" button on user interface 110 to select an Operations Settings Menu. Two of the pushbuttons in the Operations Settings Menu serve to increase or decrease, respectively, the delay time for the Needle Heater Maintenance Cycle. The electronic controller used to control the pre-roll infuser is configured to monitor time that has elapsed since the last up-down cycling of elevator 124. The electronic controller effectively acts as a timer, and if the time elapsed exceeds a predetermined threshold, the electronic controller triggers the elevator to exercise a cycle of raising and lowering the tube support elevator without pumping any fluid. It does not matter whether a support tube is currently inserted within the tube support nest or not. In either case, elevator is operated to raise and lower the tube support nest, and in so doing, needle heater 910 moves up and down over infusion needle 906 to heat viscous fluid within infusing needle 906.

Figure 16:
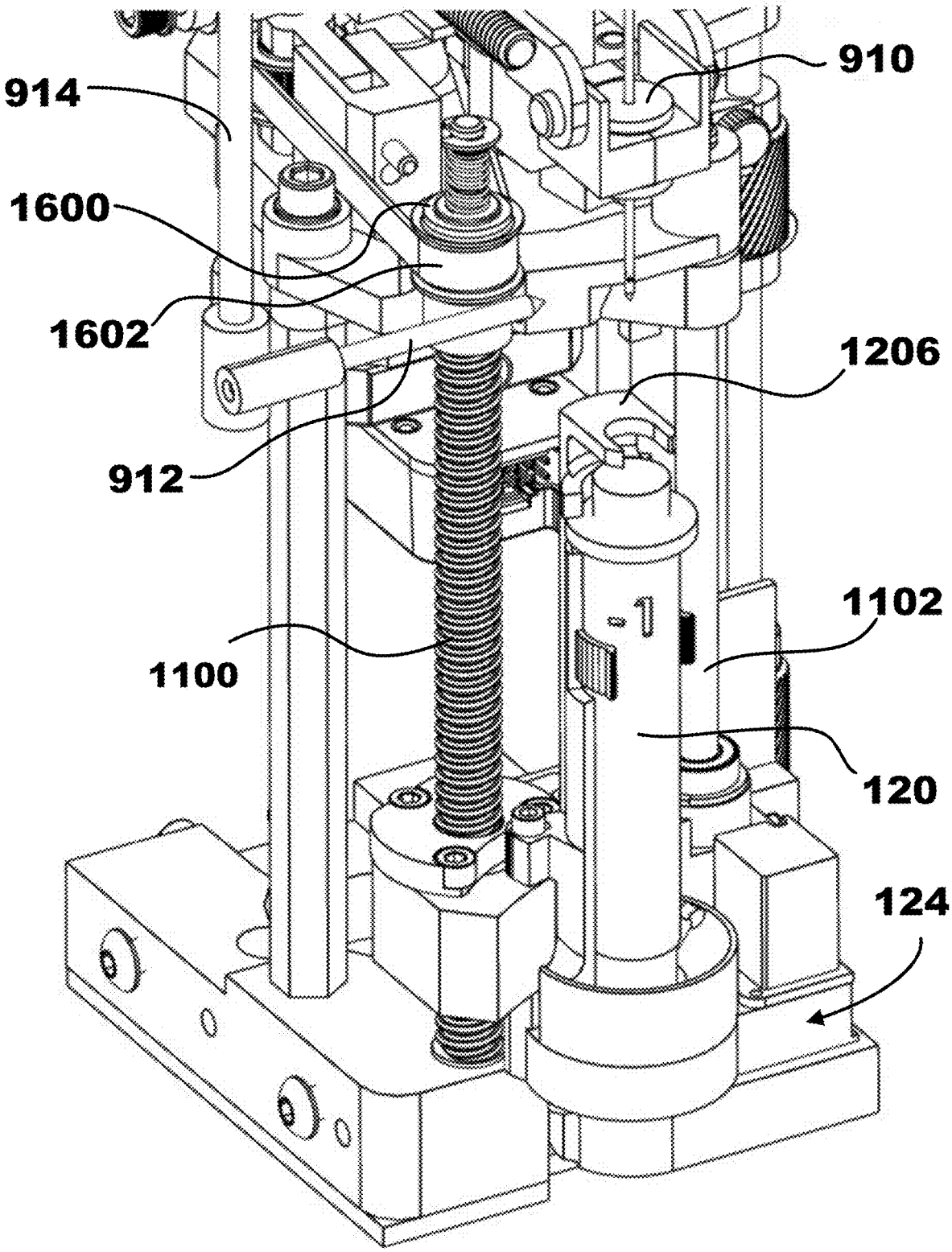
FIG. 16 is a perspective view of the elevator mechanism for raising and lowering a support tube used to support a pre-roll for infusion.
Figure 17:
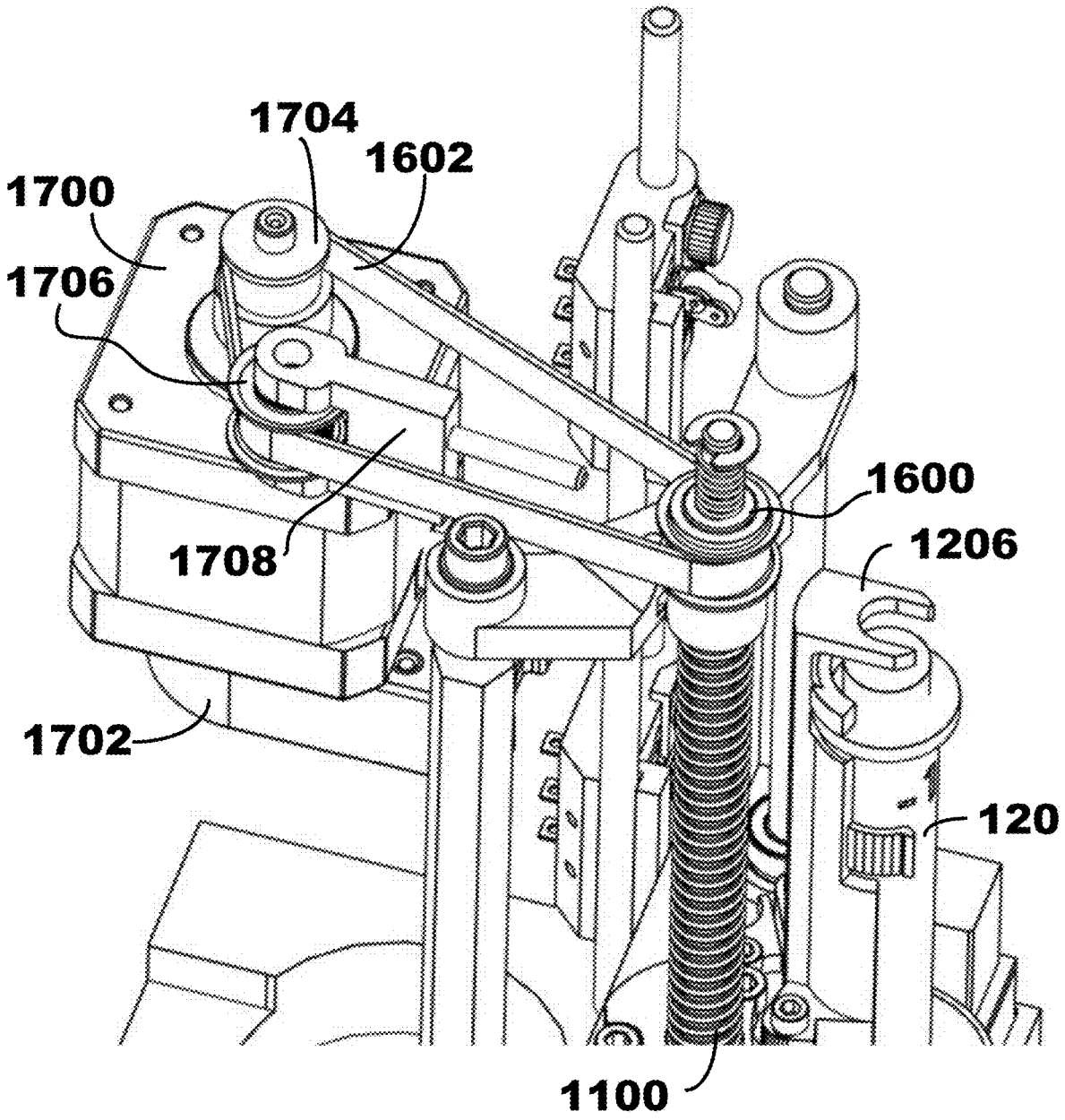
FIG. 17 is a perspective view showing a stepper motor, associated encoder, drive belt, and rotating screw shaft used to raise and lower the elevator platform.

In FIG. 16, tube support elevator 124 is shown in its lowered position, with tube support member 120 inserted into a tube support nest of elevator 124. At the top of elevator screw rod 1100, a pulley 1600 is secured and engaged with a drivebelt 1602 for rotating screw rod 1100 in either of two opposite directions, one to raise elevator 124, and the other to lower elevator 124. In FIG. 17, components are hidden to better illustrate the stepper motor used to control screw rod 1100. Stepper motor 1700 includes a driveshaft that extends upwardly to drive pulley 1704. The driveshaft of stepper motor 1700 also extends downwardly into a digital encoder 1702. Digital encoder 1702 may be an E5 Series rotary encoder commercially available from US Digital of Vancouver, Washington, which can generate between 128 to 20,000 pulses for each complete revolution of the stepper motor driveshaft, thereby permitting precise determination of the position of stepper motor 1700. The pulses generated by encoder 1702 are provided to the electronic controller of the pre-roll infuser to monitor stepper motor speed and elevator elevation, among other parameters. The electronic controller of the pre-roll infuser, which may be a PLC type controller, controls the electrical drive signals applied stepper motor 1700. Still referring to FIG. 17, drivebelt 1602 is also engaged with belt tensioner pulley 1706, which is in turn supported by a tensioner yoke 1708, the position of which is adjustable to maintain proper tension on drivebelt 1602.

Figure 18:
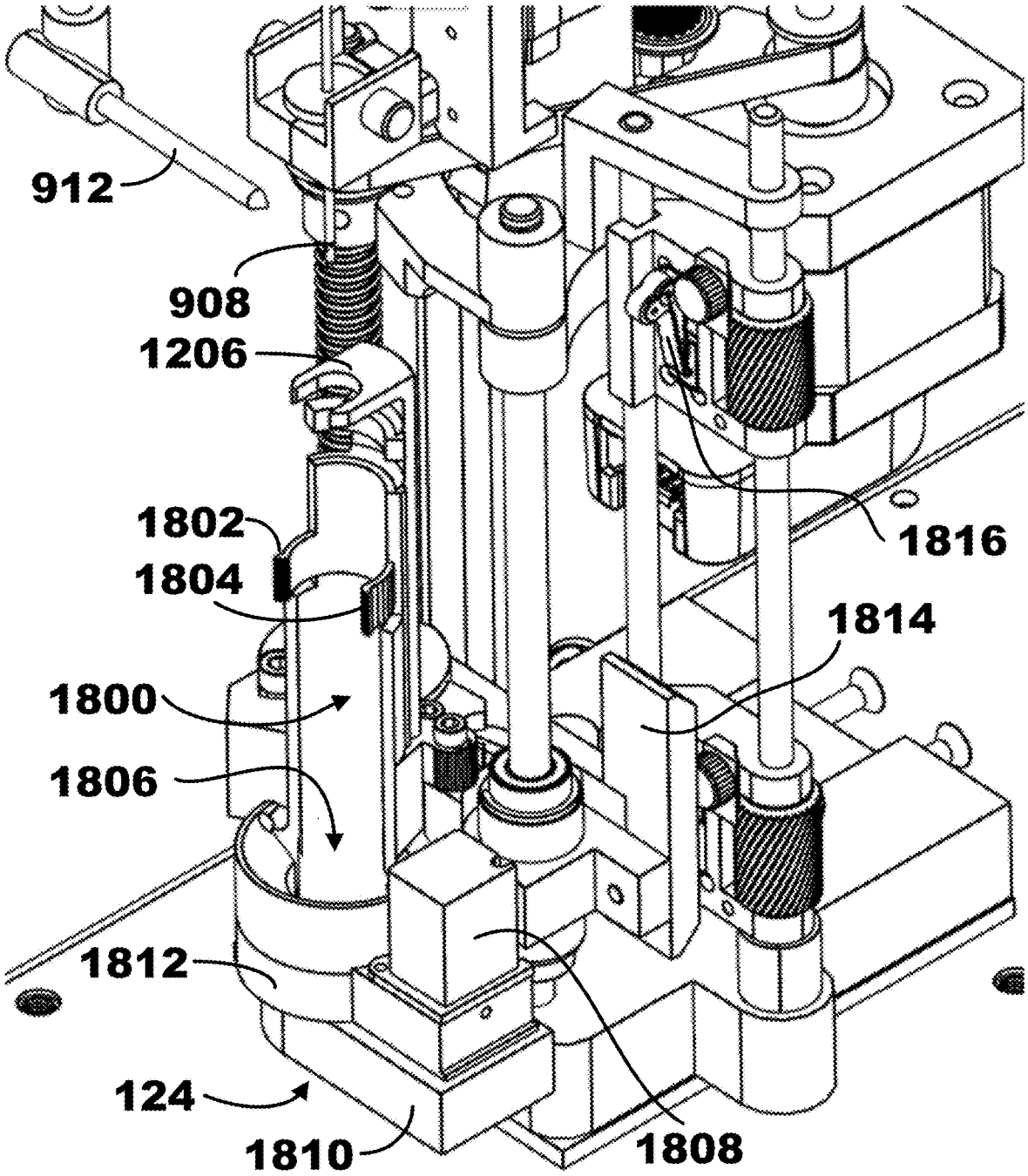
FIG. 18 is a perspective view of the elevator mechanism after removing the pre-roll support tube.

Turning now to FIG. 18, tube support elevator 124 is shown with the support tube removed. Tube support nest 1800 includes uppermost member 1206 for contacting the needle heater. Tube support nest 1800 also includes a pair of projecting fingers 1802 and 1804 for loosely supporting the upper portion of a support tube. By "loosely supporting", it is meant that the support tube will not escape therefrom without application of a pulling force by the user, and yet fingers 1802 and 1804 will actually allow an inserted support tube to rotate within nest 1800, if desired. Tube support nest 1800 also includes a base region 1806 for supporting the bottom of the support tube. Also visible in FIG. 18 is a switch actuator 1814 which rides up and down with elevator 124. When elevator 124 is fully raised, switch actuator 1814 engages microswitch 1816 for signaling the electronic controller that elevator 124 has been fully-raised. The position of this switch is adjustable and corresponds to how deep infusion needle 906 can become embedded within the pre-roll. Typically, microswitch 1816 is adjusted so that the spray port(s) 908 of infusion needle 906 are approximately one-half inch above the upper end of a filter attached to a typical pre-roll. While not visible in FIG. 18, a similar microswitch may be located near the base of the apparatus for being engaged by the lower portion of switch actuator 1814 to signal that the elevator has been fully-lowered.

In a particular embodiment of the pre-roll infuser, tube support nest 1800 is capable of rotating a support tube nested therein during operation of elevator 124, particularly when viscous fluid is being applied inside a pre-roll by infusion needle 906. Still referring to FIG. 18, a tube rotation motor housing 1808 is provided on elevator 124. Housings 1810 and 1812 surround drive rings and a connecting drive belt for rotating base region 1806 of tube support nest 1800.

Figure 19:
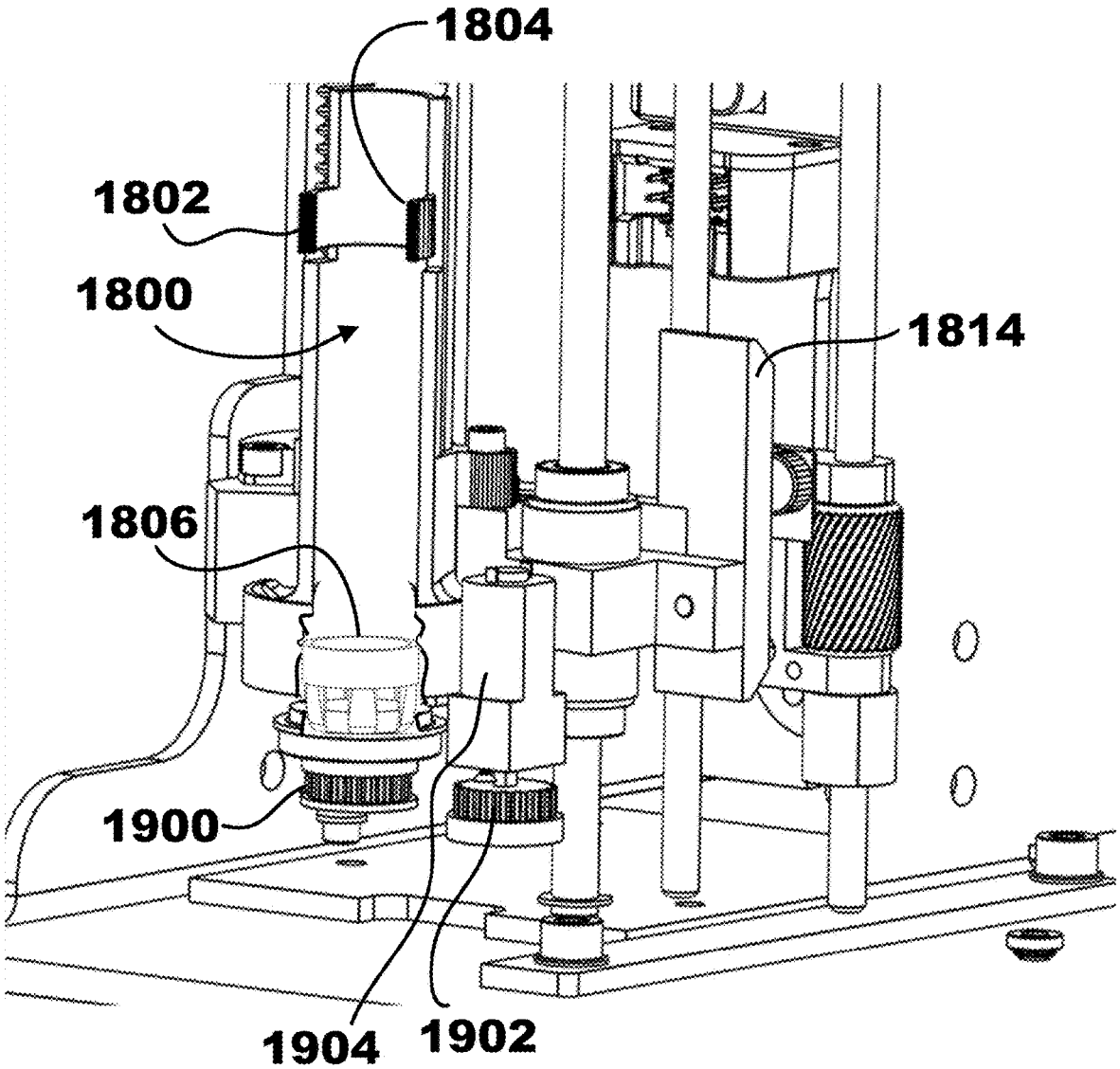
FIG. 19 is a perspective view of the elevator after hiding housings covering a tube rotation motor and associated drive gear rings used to rotate a tube support member.
Figure 20:
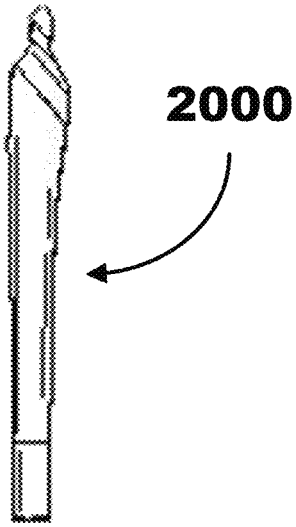
FIGS. 20 and 21 illustrate two different types of pre-rolls having different sizes and contours.
Figure 21:
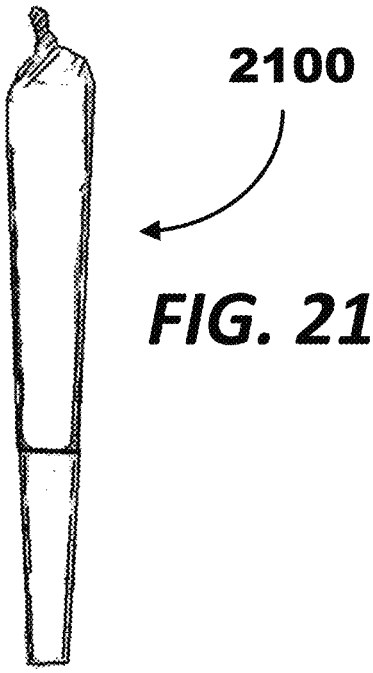
Figure 22:
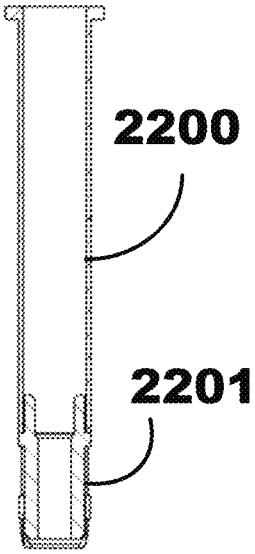
FIGS. 22 and 23 illustrate two different types of tube support members having different sizes and inner contours.
Figure 23:
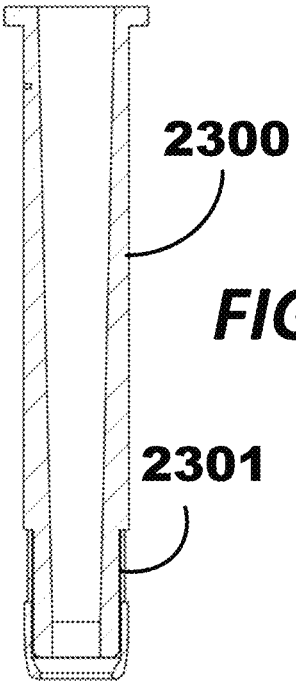

In FIG. 19, motor housing 1808, housings 1810 and 1812, and a lower portion of tube support nest 1800, have been hidden from view to reveal motor 1904, drive pulley 1902 and a pulley 1900 secured to base member 1806 of tube support nest 1800. Base member 1806 is adapted to grippingly engage the bottom of an inserted support tube; accordingly, rotation of base member 1806 also causes rotation of the support tube inserted therein. A drive belt (not shown for clarity) extends between drive pulley 1902 and pulley 1900. Motor 1904 is controlled by the electronic controller of the pre-roll infuser for operating when viscous fluid is being pumped from infusion needle 906 into the pre-roll. In this manner, the pre-roll support tube, and the pre-roll supported therein, are rotated as the viscous fluid is pumped out of the infusion needle spray port to help insure uniform application of the viscous fluid within the pre-roll.

Referring now to FIGS. 20-23, pre-rolls come in a variety of shapes and sizes. For example, in FIG. 20, pre-roll 2000 is relatively short and thin as compared with pre-roll 2100 shown in FIG. 21. To account for such differences, a variety of tube support members, like those shown in FIG. 22 as tube support member 2200 and in FIG. 23 as tube support member 2300, may be provided for use with the described pre-roll infuser. Both tube support members 2200 and 2300 can be received within the tube support nest 1800 for infusing pre-rolls inserted therein. If desired, such tube support members may include a metallic ring (2201 in FIG. 22; 2301 in FIG. 23) that can be sensed by a sensor to confirm that a tube support member has been inserted into the tube support nest in order to trigger the electronic controller to begin an infusion cycle.

Figure 24:
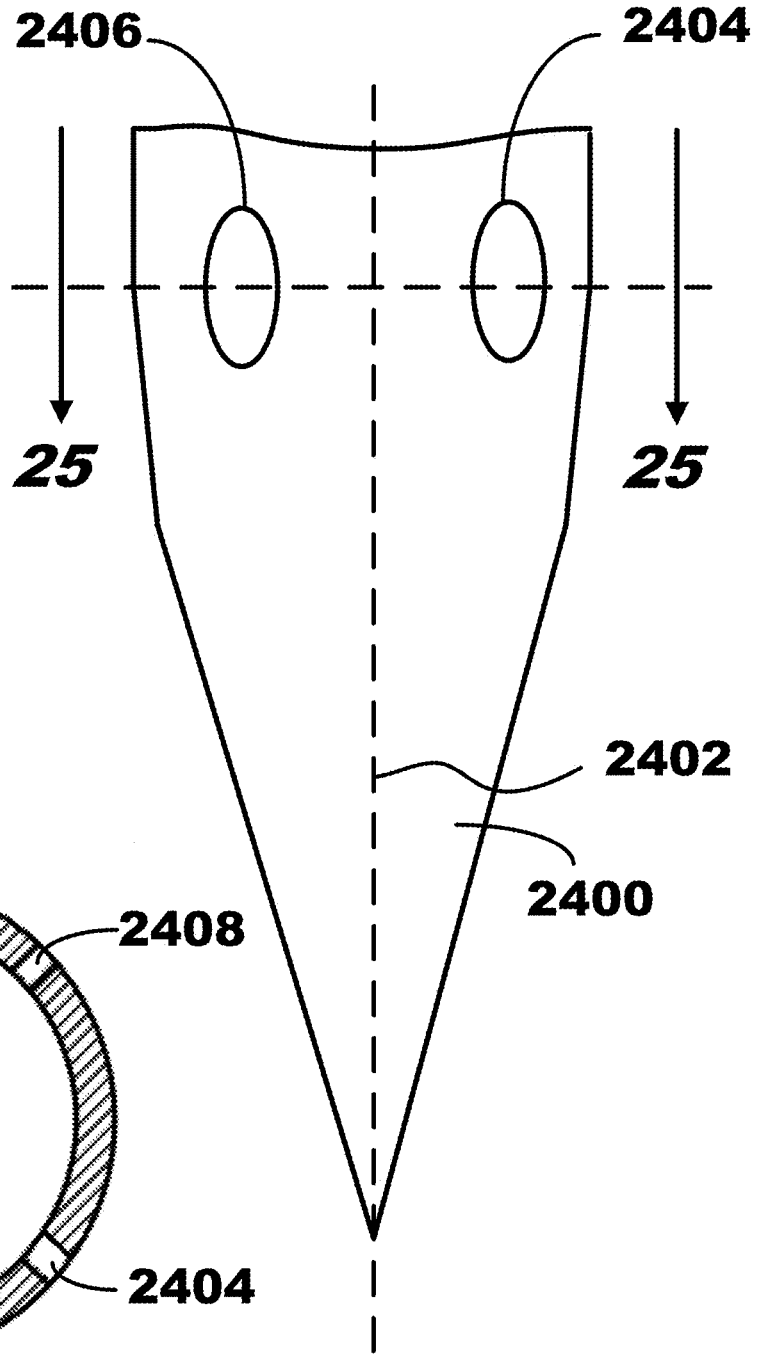
FIGS. 24 and 25 illustrate an improved infusion needle having four spray ports arranged at 90-degree increments about the longitudinal axis of the infusion needle.
Figure 25:
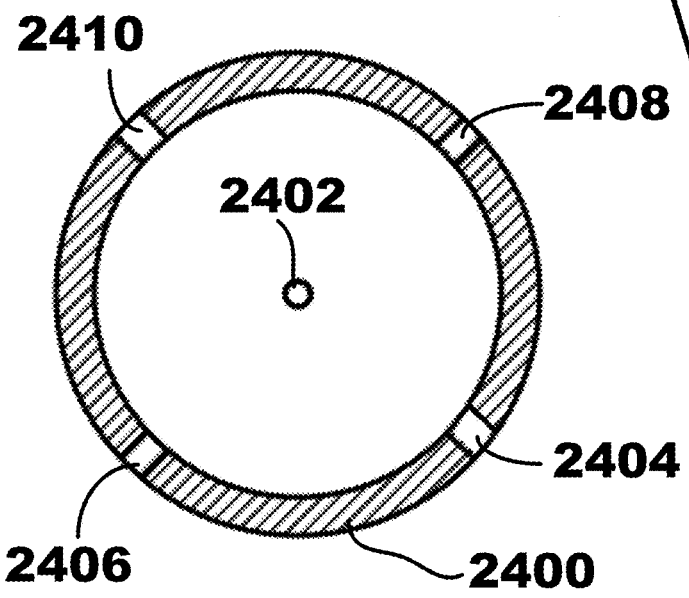

Turning now to FIGS. 24 and 25, an improved infusion needle 2400 is shown extending about a longitudinal axis 2402. In FIG. 24, two spray ports 2404 and 2406 are visible. In the cross-sectional view of FIG. 25, two additional spray ports 2408 and 2410, are also visible. It is preferred that such spray ports are spaced about longitudinal axis 2402 at equally-spaced angular increments. In the case of four spray ports, such ports are spaced at 90-degree increments. The use of four spray ports is but one example. Alternatively, two spray ports could be used and spaced 180 degrees apart, or three spray ports could be used and spaced at 120-degree increments. In the specific example of four spray ports shown in FIG. 25, one pair of ports (2406 and 2408) can be positioned along needle 2400 as currently shown, while the second pair of ports (2404 and 2410) may be shifted slightly higher, or slightly lower, along longitudinal axis 2402 of needle 2400 if desired to apply the viscous fluid in a more-dispersed pattern.

Figure 26:
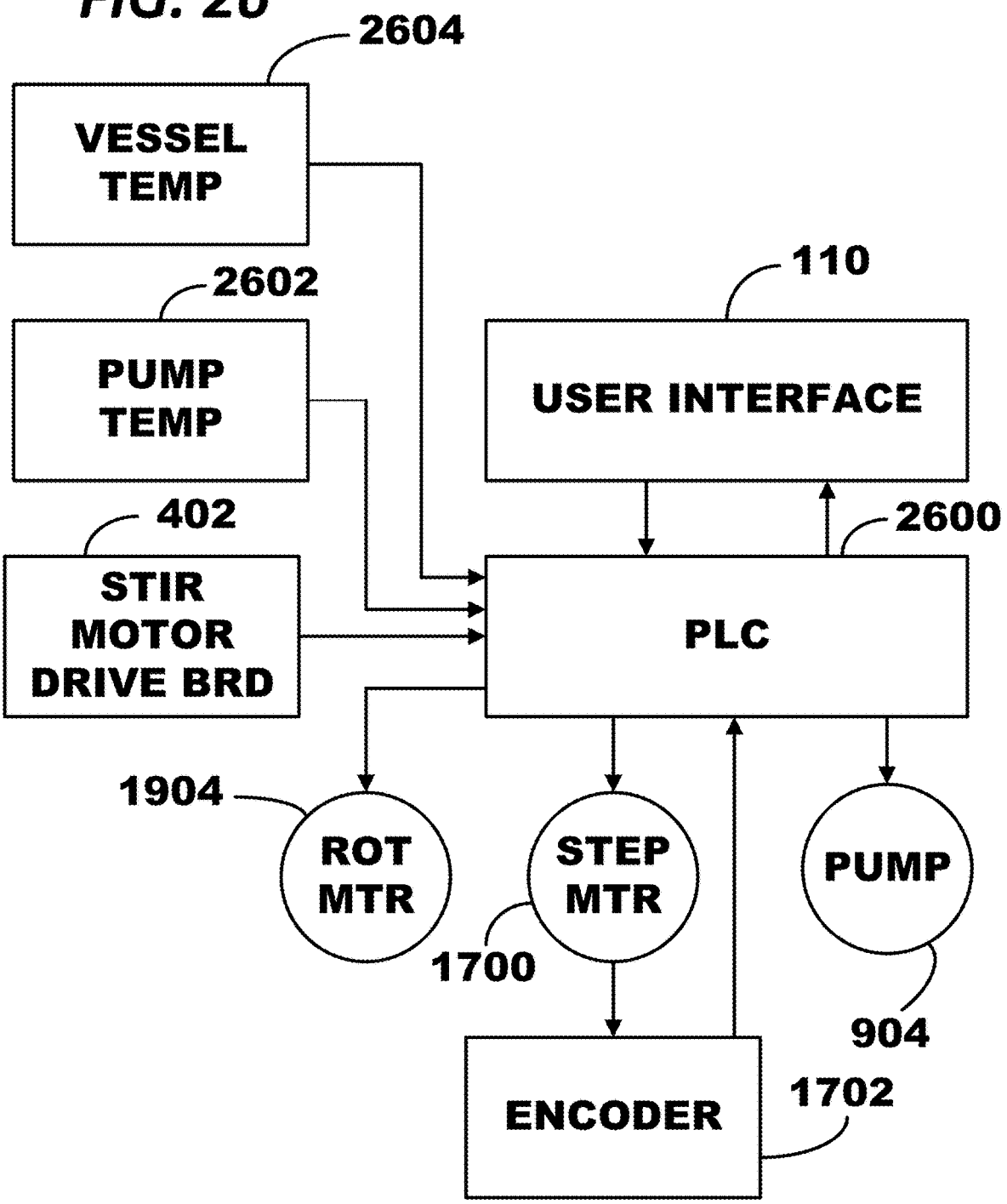
FIG. 26 is a block diagram showing the major electronic/electromechanical components of the pre-roll infuser apparatus.

FIG. 26 illustrates in block diagram form the major electronic/electromechanical components of the pre-roll infuser. All operations are controlled by PLC electronic controller 2600. User interface 110 is coupled to PLC 2600 and receives information from PLC 2600 and also sends information to PLC 2600. PLC 2600 controls pump motor 904, elevator stepper motor 1700, and tube rotation motor 1904. PLC 2600 receives digital pulses from stepper motor encoder 1702. PLC 2600 receives current draw information from stirrer motor drive board 402 to determine the current viscosity of fluid in the fluid vessel, and also receives temperature data from vessel temperature sensor 2604 and pump temperature sensor 2602.

In one configuration of the pre-roll infuser, loading of the pre-roll tube is sensed via a magnetic sensor that senses a metal band incorporated in the pre-roll support tube for automatically activating the support tube elevator. The elevator moves up at full speed until the elevator is at the prescribed dispense start point. The elevator then begins to lower at a speed calculated by the electronic controller based upon user-selected parameters while the fluid pump dispenses the viscous fluid at a set rate matching user-desired inputs. The elevator continues downward until the pump finishes dispensing the fluid, and then switches into full speed movement to the bottom. The pre-roll support tube containing the infused pre-roll is removed from the tube support nest, and the next pre-roll support tube (with its pre-roll) is inserted into the support tube nest. While the next pre-roll is being infused, the operator ejects the finished infused pre-roll from its support tube and loads the next pre-roll into another support tube ready for infusion.

A user initially sets up the pre-roll infuser 100 of FIG. 1 for use in the following manner. Using the user interface 110 (see FIG. 1), the user sets the desired temperature (for example, 50 degrees C.) for heating vessel 102 and fluid pump 1000. The user then selects the rotational speed of the fluid pump 1000 (e.g., 120 rpm). The user waits for display panel 112 to show that the heating vessel 102 and fluid pump 1000 are both at the required temperature before setting up the pump parameters. When determining the parameters of a pump cycle, the user first determines where (within the pre-roll) the oil concentrate is to be sprayed. The user measures the total distance from the starting point to the ending point. The end point is chosen toward the top of the pre-roll, but low enough to compensate for shorter pre-rolls within the same lot of pre-rolls to be infused; otherwise, hot oil might be sprayed above the shorter pre-rolls rather than inside them. The total infused length is divided by 0.2" to get the number of desired pump strokes or cycles. By way of example, if it is decided that infusion will start at a point that is two-thirds of the length of the smokable part of the pre-roll, and the stop point will be one-quarter inch below the top of the pre-roll, and this distance is measured to be 1.4 inches, then dividing 1.4 inches by 0.2" results in 7 pump cycles. The user then sets the number of pump cycles to 7 using user interface 110.

Next, in a Setup Screen mode, the user cycles the operation of the fluid pump without operating the elevator 124, and places a small beaker under the infusion needle to catch the dispensed oil. This initial cycling of fluid pump 1000 allows the electronic controller to capture the "pump time" (the amount of time required by the pump to implement 7 pump cycles in the example above). The electronic controller uses this information to control the speed of the elevator during an actual infusion cycle to accurately coordinate the dispensing of oil with the position of needle spray port 908 within the pre-roll as the infusion process occurs.

As mentioned above, pre-rolls come in different sizes and lengths. Each different pre-roll size will have a specific pre-roll support tube to use in the infusion process. The pre-roll support tubes can be numbered, for example, "2", "1", "0", "−1", "−2", etc., depending on the associated pre-roll size; the larger the number, the larger the internal contour of the support tube. While standard support tubes include a metallic ring for triggering a sensor to activate the elevator, an additional maintenance support tube (lacking the metal ring) is also provided so that the elevator sensor does not automatically cause the elevator to raise while in the "RUN" mode.

After selecting the correct pre-roll support tube type, and determining the distance within the pre-roll over which infusion is to be made, the user selects the number of pump cycles to be used. For example, a user might choose 10 pump cycles for a dispensing distance of two inches; a good rule-of-thumb is one pump cycle per 0.2" of dispense distance to achieve an even infusion without obvious thin sections. A user must also decide the amount of material to be dispensed into each pre-roll. In this example, a user has chosen 0.4 grams of oil. The user has already selected a pump motor speed of 120 rpm, and the user then proceeds to the pump setup process in which the pump angle is adjusted to achieve 0.4 grams of total volume over the course of 10 revolutions of the pump. Fine adjustment of the amount of oil dispensed by the pump can be achieved by mechanically adjusting the pump angle using a pump angle adjustment knob.

At this point, the user has selected the pre-roll size, the pre-roll support tube type, the amount of oil to be dispensed, the temperatures of the oil to flow correctly, the pump angle, and the pump speed. The user's next task is to specify where, within the pre-roll, the oil is to be dispensed. To accurately adjust the start and stop points between which oil will be dispensed within the pre-roll, the user makes use of pointer 912, which the user adjusts to point at the needle spray port(s). The user presses the SETUP button on user interface 110 to get into the setup mode, which allows a user to "dry cycle" the infusion steps without actually dispensing oil to define where the dispensing of oil will occur. One of the buttons on user interface 110 cycles the pump for setting the amount of infusion as well as for capturing the "Pump Time" variable (the amount of time required for the pump to dispense the desired total amount of oil). This allows the electronic controller to calculate the speed at which elevator 124 should be operated in order to coordinate the vertical distance moved by the elevator with the time required by the pump to apply the desired amount of oil. The user then selects a dispense position setup menu on user interface 110 to specifically define where the infusion starts and stops along the pre-roll.

As noted above, an upper limit microswitch 1816 limits how far into the pre-roll the infusion needle can extend. While in the dispense position setup mode, a user presses an "UP" button using interface 110 to move the elevator upwards until the upper limit microswitch 1816 is triggered. The user confirms that this represents where the user wants the infusion to start by pressing a SAVE button twice. The user then presses a "DOWN" button on user interface 110 to lower support tube elevator 124 until pointer 912 is pointing just below the top of the shortest pre-roll to be infused. The user saves this position by pressing the SAVE button on user interface 110. The electronic controller uses this saved position to automatically adjust the speed of support tube elevator 124 to match the saved "Pump Time" in order to dispense the desired amount of oil exactly between the selected start and stop points.

As described above, stepper motor 1700, used to control elevator 124, is equipped with an encoder 1702 to allow the electronic controller to monitor the current position of elevator 124. Encoder 1702 also facilitates driving elevator 124 accurately and consistently by controlling the speed of stepping motor 1700 to coincide the required pumping time while moving over the desired infusion distance.

The user then presses the "DOWN" button on user interface 110 to lower elevator 124 all the way to the bottom. As described above, a microswitch is located near the base of the apparatus for being engaged by the lower portion of switch actuator 1814 to signal that elevator 124 has been fully-lowered. At this point, the user has finished establishing the infusion parameters. The user then presses the "RUN" button on user interface 110 and may begins infusing the first pre-roll by inserting a loaded support tube into tube support nest 1800 of elevator 124.

Those skilled in the art will appreciate that an improved pre-roll infusing apparatus has been described for infusing pre-rolls with THC oil or other viscous fluids in a quick, repeatable and reliable manner. The disclosed pre-roll infuser is capable of achieving a highly uniform infusion of THC oil within the pre-roll. Safeguards are provided to prevent coagulation and/or clotting within the pre-roll infuser to prevent costly downtime and maintain high quality control over the finished product. Users are provided with a high degree of control over the amount of THC oil infused into the pre-roll. Use of tube support members having different internal contours for accommodating differently-sized pre-rolls, all designed to fit within tube support nest, provides the described pre-roll infuser a high degree of versatility.

The embodiments specifically illustrated and/or described herein are provided merely to exemplify particular applications of the invention. These descriptions and drawings should not be considered in a limiting sense, as it is understood that the present invention is in no way limited to only the disclosed embodiments. It will be appreciated that various modifications or adaptations of the methods and or specific structures described herein may become apparent to those skilled in the art. All such modifications, adaptations, or variations are considered to be within the spirit and scope of the present invention, and within the scope of the appended claims.

I claim:

1. Apparatus for introducing a viscous fluid into an object comprising in combination:

a supply of viscous fluid;

a fluid pump having an inlet coupled to the supply of viscous fluid for receiving viscous fluid therefrom, the fluid pump including an outlet, and the fluid pump selectively pumping the viscous fluid from the outlet thereof;

a needle coupled to the outlet of the fluid pump, the needle having at least one port for dispensing fluid therefrom into the object when the fluid pump selectively pumps the viscous fluid;

a support for holding the object in which the viscous fluid is being introduced;

a stirrer disposed within the supply of viscous fluid to stir the viscous fluid therein;

a stirring motor coupled to the stirrer for rotating the stirrer;

an electronic controller for applying electrical current to the stirring motor for causing the stirring motor to rotate, the electronic controller sensing the amount of electrical current drawn by the stirring motor, and the electronic controller prohibiting the operation of the fluid pump when electrical current drawn by the stirring motor exceeds a predetermined threshold.

2. The apparatus recited by claim 1 further including a heater for heating the supply of viscous fluid.

3. The apparatus recited by claim 2 wherein the electronic controller operates the heater when electrical current drawn by the stirring motor exceeds a predetermined threshold.

* * * * *